US006871930B2

(12) United States Patent
Umetani et al.

(10) Patent No.: US 6,871,930 B2
(45) Date of Patent: Mar. 29, 2005

(54) INKJET PRINTER

(75) Inventors: Yoshinobu Umetani, Yamatotakada (JP); Hiroshi Ishii, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/413,525

(22) Filed: Apr. 15, 2003

(65) Prior Publication Data

US 2003/0193539 A1 Oct. 16, 2003

(30) Foreign Application Priority Data

Apr. 15, 2002 (JP) ..... 2002-112536

(51) Int. Cl.[7] ..... B41J 29/393
(52) U.S. Cl. ..... 347/19
(58) Field of Search ..... 347/14, 19, 70, 347/71

(56) References Cited

U.S. PATENT DOCUMENTS 3,814,051 A * 6/1974 Lewison ..... 118/728
4,067,019 A * 1/1978 Fleischer et al. ..... 347/81
5,422,664 A * 6/1995 Stephany ..... 347/14
5,489,925 A * 2/1996 Brooks et al. ..... 347/6
6,278,469 B1 8/2001 Bland et al. ..... 347/19

FOREIGN PATENT DOCUMENTS

JP 4-369459 A 12/1992 ..... D01N/5/02
JP 2001-105586 A 4/2001 ..... B41J/2/01

* cited by examiner

*Primary Examiner*—Michael S. Brooke
(74) *Attorney, Agent, or Firm*—Birch, Stewart, Kolasch & Birch, LLP.

(57) ABSTRACT

The amount of ink ejected from a recording head is measured using a quartz crystal microbalance (QCM) method. An ink detector arranged outside an image area includes an AT-cut quartz oscillator constructed by vapor-depositing Al electrodes on both surfaces of a quartz plate, and the ink ejected from the recording head mounted on a carriage is deposited on this quartz oscillator. A change in resonant frequency caused in the quartz oscillator due to the deposition of the ink is detected, and the mass of the ink ejected from the recording head is measured based on the detection results.

12 Claims, 10 Drawing Sheets

INKJET PRINTER

BACKGROUND OF THE INVENTION

The present invention relates to an inkjet printer for forming an image on a print medium with an ink ejected from a recording head, and more particularly relates to an inkjet printer capable of measuring the amount of ink ejected from the recording head with high accuracy.

Inkjet printers have various advantages such as low cost, high print quality, and color printing capability, and have been widely used not only in offices, but also in ordinary homes with the spread of personal computers. Such an inkjet printer forms a printed image by depositing on a print medium an ink which is controllably ejected from a nozzle of a recording head in response to commands electronically transmitted to the recording head.

In order to realize high quality printing, it is necessary to always eject a constant amount of ink from the nozzle of the recording head during printing. However, since this nozzle has a very small diameter, the nozzle is sometimes clogged with dust or the like and does not eject the ink at all, or eject an incorrect amount of ink drops. In order to prevent such drawbacks, the invention of U.S. Pat. No. 6,278,469 determines the ink ejection capability of the recording head by using a sensor for detecting the flying condition of an ink drop, or an optical, piezoelectric or electrostatic impact sensor for measuring the pressure of an ink drop, and provides a print mask for controlling the amount of ink according to the determined capability.

According to the above-mentioned technique of U.S. Pat. No. 6,278,469, however, if the sensor is of an optical type, it is necessary to print a test pattern on a print medium when determining the ink ejection capability, and thus resulting in waste of the print medium. Moreover, since the piezoelectric/electrostatic sensor measures the pressure of an ink drop by an extremely weak signal, the S/N ratio is poor and there arises the problem that the amount of ink can not be measured accurately.

BRIEF SUMMARY OF THE INVENTION

The present invention has been made with the aim of solving the above problems, and it is an object of the present invention to provide an inkjet printer capable of measuring the amount of ink accurately by using a quartz crystal microbalance (hereinafter referred to as "QCM") method having very good mass detection sensitivity.

The following description will explain the content of the QCM method disclosed in Japanese Patent Application Laid-Open No. 4-369459/1992, for example. The QCM method is one of the methods for measuring a small mass based on the detection of the resonant frequency of a quartz oscillator, and uses the phenomenon that the resonant frequency changes as an object to be measured is deposited on the quartz oscillator.

When a mass change Δm [g] occurs in the thickness direction of the quartz oscillator, there is a change ΔF [Hz] in the resonant frequency as expressed by equation (1) below.

$$\Delta F=-F_0^2\cdot\Delta m/N\rho A \quad (1)$$

where $F_0$: fundamental frequency [Hz]

N: frequency constant [Hzcm]

A: electrode area [$cm^2$]

ρ: quartz density [$g/cm^3$]

When the quartz oscillator is an AT-cut quartz oscillator (with a cut angle of 35.15 degrees between the plate surface and the Z axis), since N=167 [kHzcm] and ρ=2.65 [$g/cm^3$], if a quartz oscillator having $F_0$=10 [MHz] is used, then $\Delta F=-2.2596\times10^8\times\Delta m$. Accordingly, the mass detection sensitivity of the AT-cut quartz oscillator of 10 [MHz] is 4.4 [$ng/cm^2$ Hz], and thus a high mass detection sensitivity is achieved.

Moreover, if the constant which is determined by the cut surface of the oscillator is defined as K [MHzmm], then the relationship as shown by equation (2) below is established between the fundamental frequency $F_0$ [MHz] and the thickness t [mm] of the oscillator plate. Here, the constant K takes values shown in Table 1 below for the respective cut surfaces.

$$F_0=k/t \quad (2)$$

TABLE 1

| Cut | AT | BT | CT | DT | X | Y |
|---|---|---|---|---|---|---|
| K [MHzmm] | 1.660 | 2.560 | 3.080 | 2.070 | 2.970 | 1.980 |

Based on the above relationship of (2), the thickness t [mm] of the AT-cut plate is calculated according to the fundamental frequency $F_0$ as shown in Table 2 below.

TABLE 2

| Fundamental frequency $F_0$ [MHz] | 10 | 20 | 30 |
|---|---|---|---|
| Thickness t [mm] | 0.166 | 0.083 | 0.055 |

The following description will explain an example in which the quartz oscillator of the QCM method is an overtone quartz oscillator that easily produces mechanical harmonic vibration (hereinafter referred to as an overtone). As this overtone quartz oscillator, for example, the one obtained by vapor-depositing a chrome/gold (with a thickness of 500 [Å]) on both surfaces of an AT-cut quartz plate having a diameter of 9 [mm] and a thickness of 0.083 [mm] is used. In this case, the electrode area A is 0.1256 [$cm^2$].

For example, when ninth harmonic oscillation (overtone oscillation) is performed, this overtone quartz oscillator can obtain 180 [MHz] as the oscillation frequency. In the overtone quartz vibration, the oscillation frequency $F_0$ [MHz] is calculated as shown in (3) below using the thickness t [mm] of the quartz oscillator plate, the constant K [MHzmm] determined on the basis of the cut surface of the quartz oscillator, and the order m of overtone oscillation (=3, 5, 7, . . . , 2n+1 (n is a natural number)).

$$F_0=K/(t\cdot m) \quad (3)$$

Here, a film thickness monitor of a fundamental frequency of 5 [MHz] is also provided. If the film thickness of gold is 50 [Å] and the deposition area is 8.04 [$mm^2$], then the mass (Δm) of the deposited gold is 780 ng as the density of gold is 19.3 [$g/cm^3$]. In this case, since the frequency is 181.005830 [MHz] before deposition and 180.735832 [MHz] after deposition, the frequency change ΔF is −270008 [Hz]. Accordingly, the mass detection sensitivity is 0.023 [$ng/cm^2Hz$].

An inkjet printer of the present invention comprising a head for ejecting an ink comprises an oscillator on which the ink ejected from the head is deposited, and detecting means for detecting a change in resonant frequency caused in the oscillator when the ink is deposited on the vibrating oscillator.

As described above, the QCM method is a method having extremely good mass detection sensitivity. Therefore, the present invention uses this QCM method and measures the amount of ink with high accuracy. The inkjet printer of the present invention detects a change in the resonant frequency of the oscillator which is caused by deposition of the ink on the oscillator, and measures the amount of the ejected ink, based on the detection results. Thus, the amount of ink is measured with high sensitivity and high accuracy compared to conventional optical, piezoelectric or electrostatic impact sensors that measure the pressure of an ink drop.

In the inkjet printer, the ink is deposited on the oscillator in a plurality of drops. By depositing a plurality of drops of ink, the ink drops on the oscillator change largely, i.e., the ink drops expand and form a uniform ink film. As a result, it becomes possible to measure the amount of ink with high accuracy.

In the inkjet printer, the vibration of the oscillator is vibration due to oscillation at the fundamental frequency. A stable and highly reliable vibration state is obtained by the oscillation at the fundamental frequency (first oscillation mode), and the detection accuracy for the ink amount is improved.

In the inkjet printer, the vibration of the oscillator is vibration due to overtone oscillation. Since the oscillator is vibrated by the overtone oscillation, a several times higher detection sensitivity is obtained compared to the fundamental frequency, and the mechanical strength of the oscillator is improved.

The inkjet printer comprises frequency dividing means for dividing the resonant frequency of the oscillator. After dividing the output of the oscillator, the cycle (frequency) is measured, and therefore the amount of ink is measured with high resolution.

In the inkjet printer, a surface of the oscillator on which the ink is to be deposited is covered with an insulating film. Since the surface of the oscillator on which the ink is to be deposited is covered with an insulating film made mainly of materials such as Parylene (poly-p-xylylene) and has particularly high surface leakage properties and good insulating properties, there is no possibility of deterioration due to ink.

In the inkjet printer, the oscillator is arranged horizontally. When the detection surface is perpendicular, the distribution of ink is biased toward the lower side due to self-weight. Whereas, in the inkjet printer of the present invention, since the oscillator is arranged horizontally, ink drops form a uniform ink film with uniform self-weight.

The above and further objects and features of the invention will more fully be apparent from the following detailed description with accompanying drawings.

DETAILED DESCRIPTION OF THE INVENTION

Figure 1:
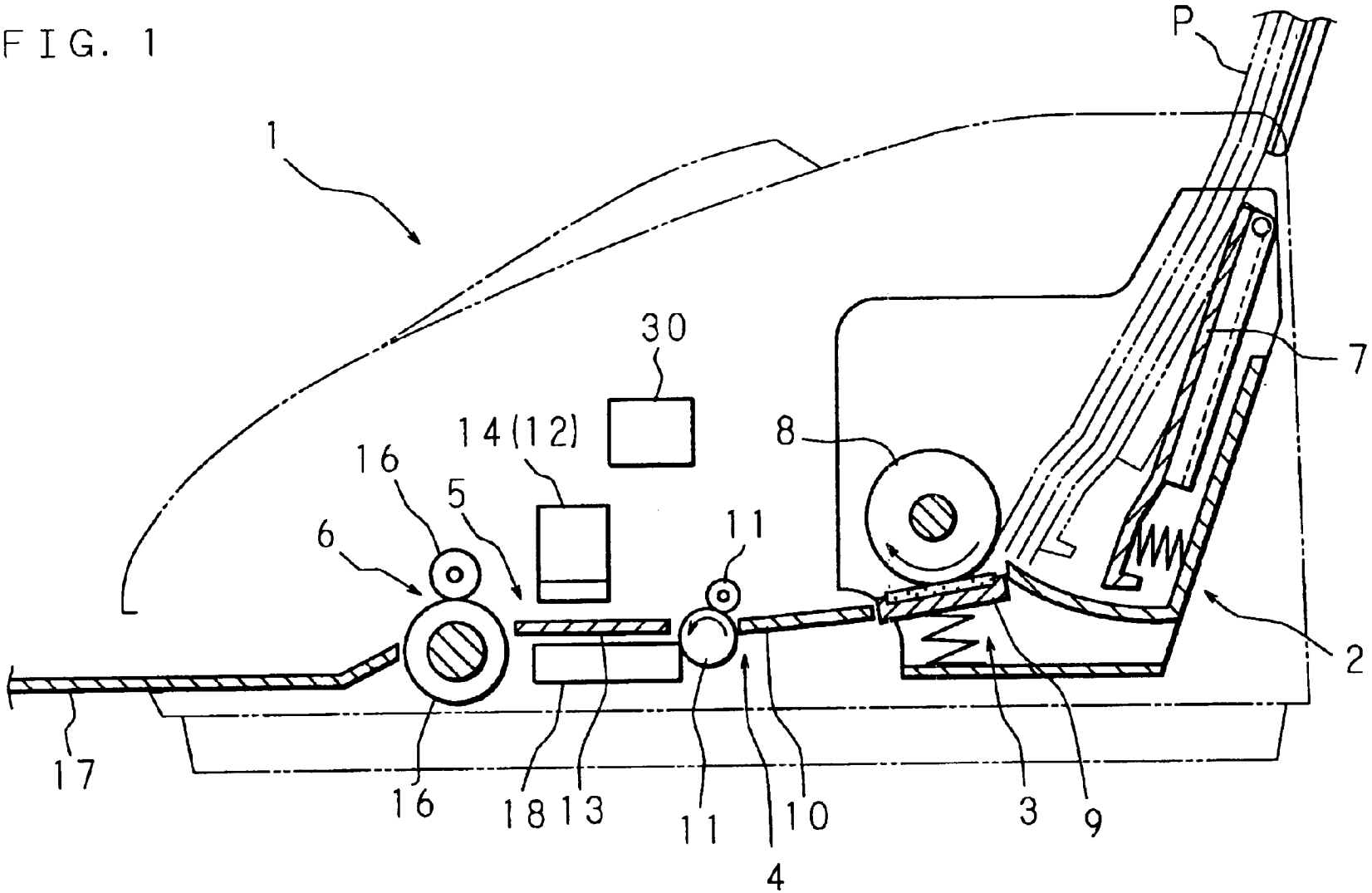
FIG. 1 is a cross sectional view of an inkjet printer of the present invention.
Figure 2:
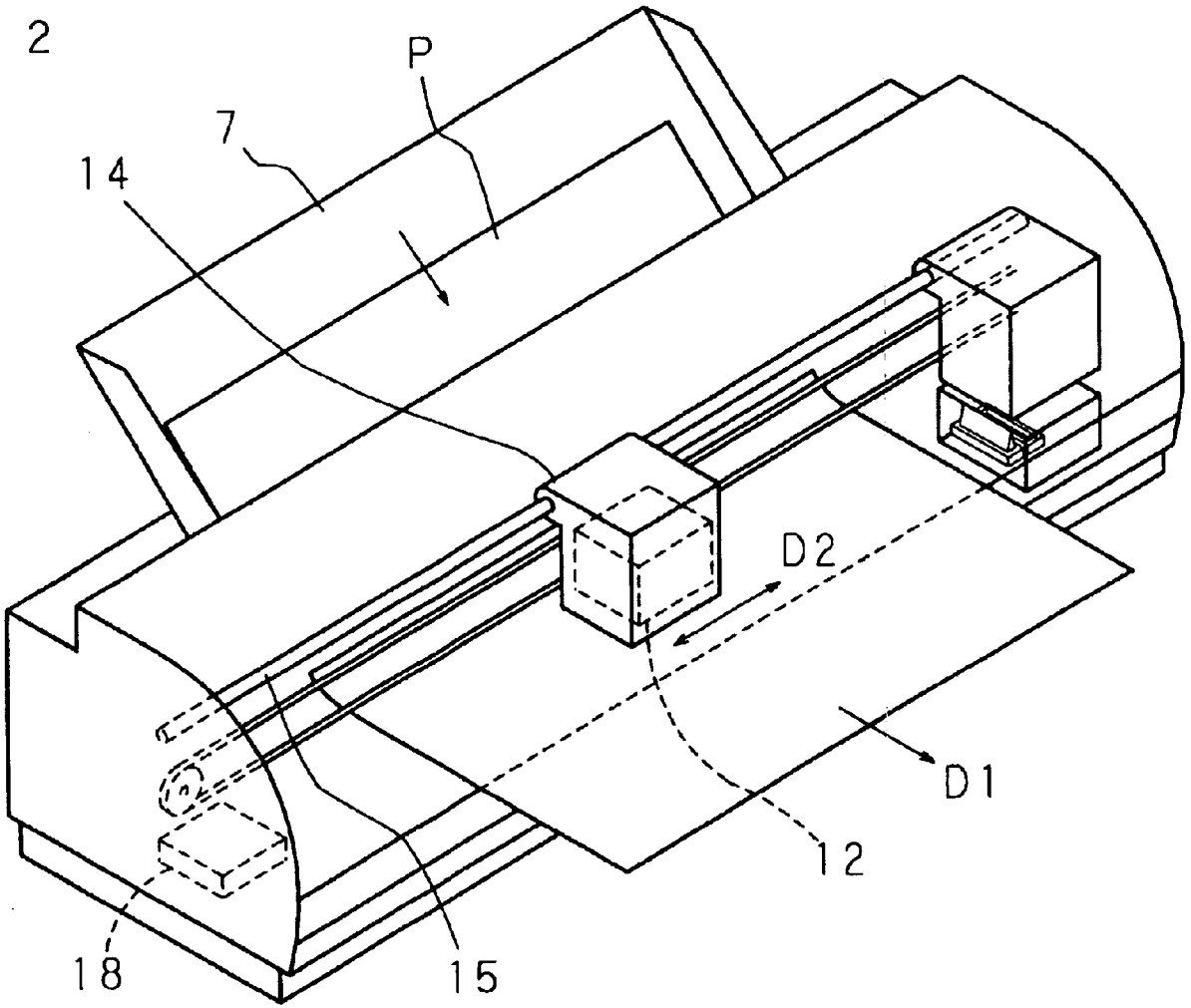
FIG. 2 is a perspective view of the inkjet printer of the present invention.

The following description will explain the present invention in detail, based on the drawings illustrating some embodiments thereof. FIG. 1 and FIG. 2 are the cross sectional view and perspective view of an inkjet printer according to an embodiment of the present invention.

As shown in FIG. 1, an inkjet printer 1 comprises a paper feed unit 2, a separating unit 3, a transfer unit 4, a printing unit 5, a discharge unit 6, an ink detector 18, and a control unit 30. The paper feed unit 2 includes a paper feed tray 7 and a pickup roller (not shown), and performs the function of supplying sheets P when executing printing, or performs the function of storing the sheets P when printing is not executed.

The separating unit 3 includes a paper feed roller 8 and a separator 9, and performs the function of feeding the sheets P supplied from the paper feed unit 2, one sheet at a time, to the transfer unit 4. At the separator 9, the friction between a pad section (a contact section with a sheet P) and the sheet P is set larger than the friction between sheets P. Whereas, at the paper feed roller 8, the friction between the paper feed roller 8 and the sheet P is set larger than the friction between the pad section (contact section with the sheet P) and the sheet P and the friction between sheets P. Therefore, even when two sheets P are supplied to the separating unit 3, these sheets P are separated from each other by the paper feed roller 8, and only the top sheet P is transferred to the transfer unit 4.

The transfer unit 4 includes a guide plate 10 and a roller pair 11, and performs the function of transferring the sheet P fed from the separating unit 3 to the printing unit 5. The printing unit 5 includes a recording head 12, a platen 13, a carriage 14 and a guide shaft 15, and performs the function of printing an image on the sheet P transferred from the transfer unit 4. The recording head 12 forms an image by spraying an ink onto the sheet P. The platen 13 functions as a platen for the sheet P during printing. The carriage 14 holds the recording head 12 thereon, and the guide shaft 15 guides the carriage 14 (see FIG. 2). When transferring the sheet P to between the recording head 12 and the platen 13, the roller pair 11 of the transfer unit 4 adjusts the transfer of the sheet P so that the ink from the recording head 12 is sprayed onto a correct position on the sheet P.

The discharge unit 6 includes discharge rollers 16, a discharge tray 17 and an ink drying section (not shown), and performs the function of discharging the printed sheet P out of the inkjet printer 1.

The ink detector 18 is positioned on one end (the left end in FIG. 2) outside the image area. When measuring the amount of ink, the carriage 14 holding the recording head 12 thereon moves to the left end, so that the ink ejecting face of the recording head 12 faces the ink detector 18.

Figure 3:
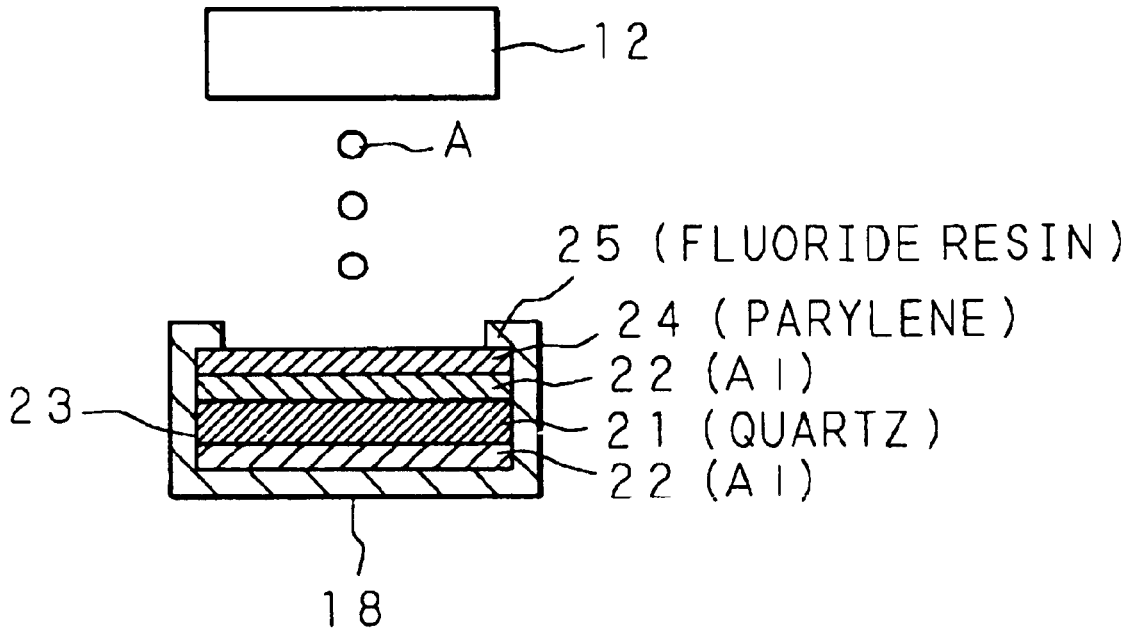
FIG. 3 is a cross sectional view showing the structure of an ink detector.
Figure 4:
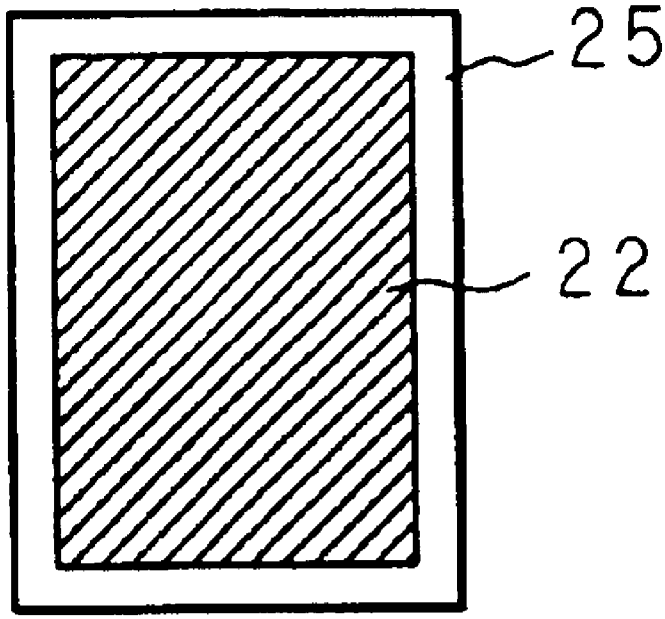
FIG. 4 is a top view showing the structure of the ink detector.

FIG. 3 and FIG. 4 are the cross sectional view and top view showing the structure of this ink detector 18. The ink detector 18 comprises an AT-cut quartz oscillator 23 (with a cut angle of 35.15 degrees between the plate surface and the Z axis) constructed by vapor-depositing Al (aluminum) electrodes 22 on both surfaces of a plate quartz 21, and an ink drop A ejected from the recording head 12 is deposited on the quartz oscillator 23. The Al electrode 22 on which the ink drop A is to be deposited is covered with a Parylene film 24 made from Parylene (poly-para-xylylene), which was formed by vapor phase epitaxial growth at room temperature and then treated with plasma ions to have a hydrophilic surface. Moreover, the bottom surface of the quartz oscillator 23, the side faces of the quartz oscillator 23 and Parylene film 24, and the outside edge of the top surface of the Parylene film 24 are covered with a fluoride resin film 25 made from Teflon (registered trademark), for example.

Figures 5A, 5B, 5C:
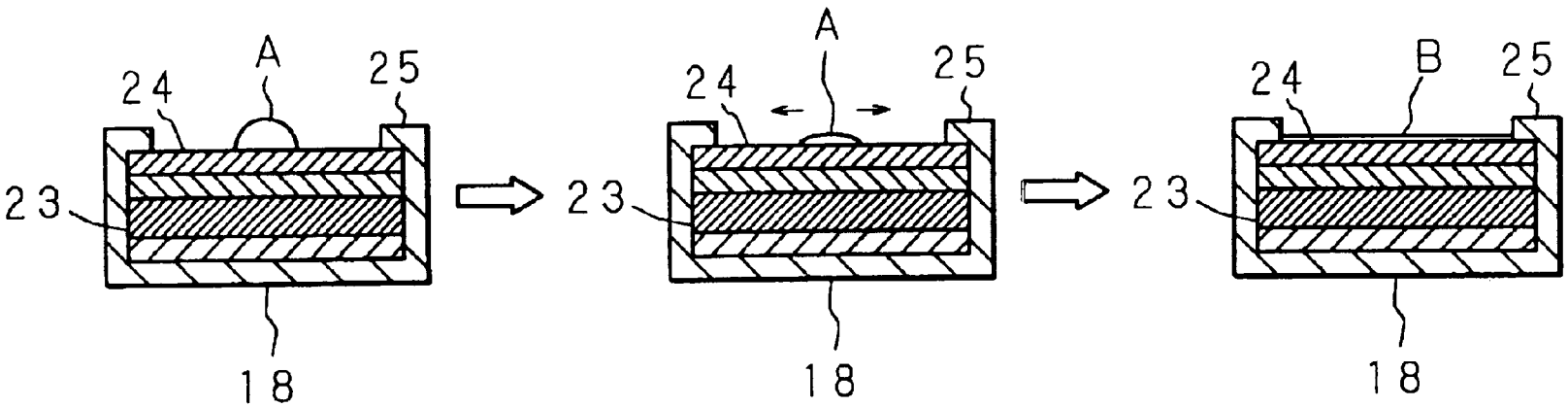
FIGS. 5A–5C are views showing the deposition state of an ink drop.

Parylene is a material with high hydrophilic/insulating properties, while Teflon is a material with high water repellent properties. Therefore, as shown in FIGS. 5A–5C, when the ink drop A is deposited (FIG. 5A), the ink drop A spreads rapidly over the Parylene film 24 (FIG. 5B), but the spread of the ink drop A is stopped by the fluoride resin film 25 on the outside edge and an ink film B is formed (FIG. 5C). In the case where a plurality of ink drops A are to be deposited, since the amount of ink increases, the ink spreads easily over the entire area of the Parylene film 24, and the ink film with a uniform thickness is obtained. Thus, in the present invention, since the insulating Parylene film 24 whose surface was treated with plasma ions to be hydrophilic is provided and a plurality of ink drops are deposited, it is possible to form an ink film having a uniform thickness in a stable manner. As a result, the accuracy of measurement of the amount of ink by a later-described QCM method increases.

Figure 6:
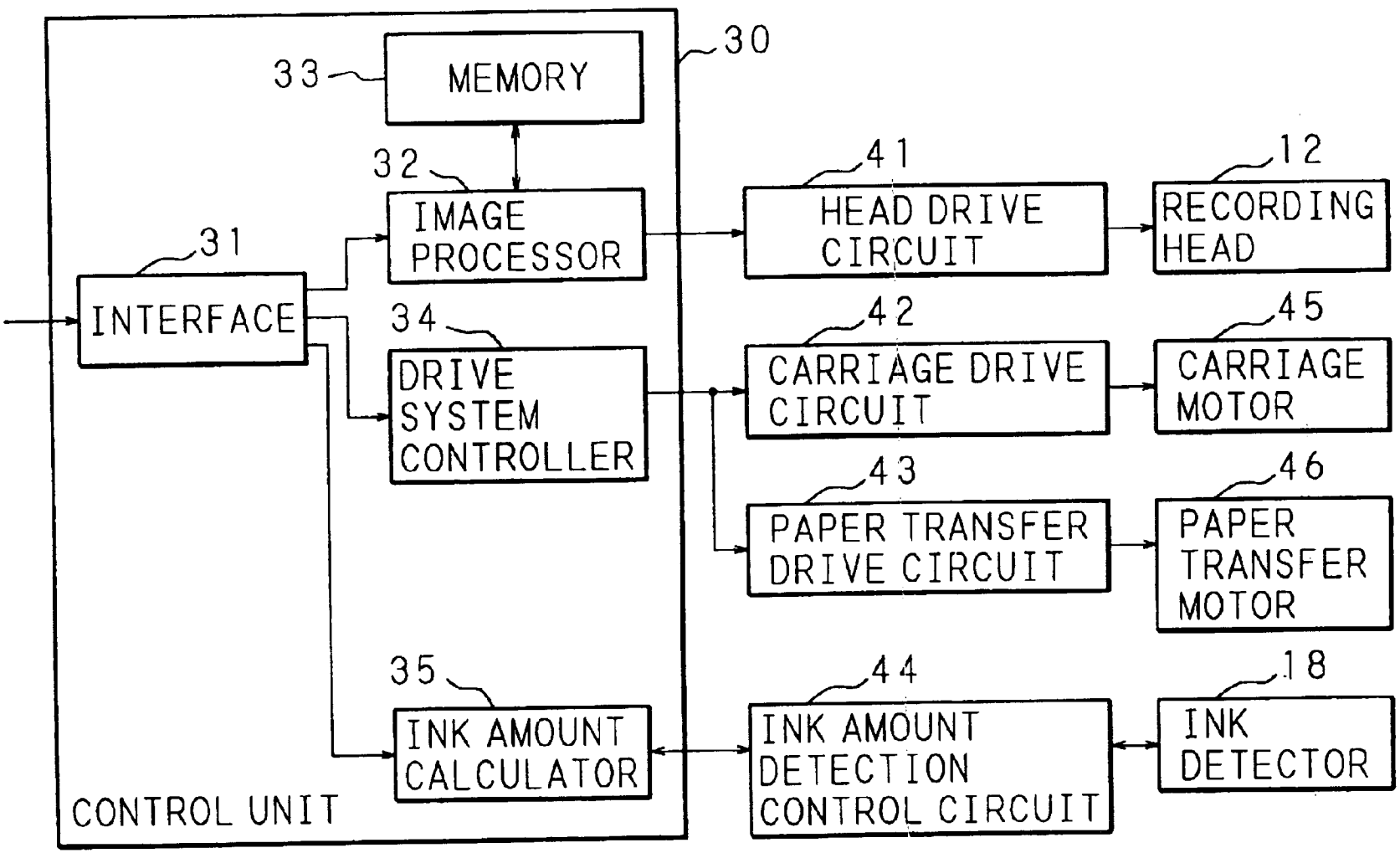
FIG. 6 is a view showing the structures of a control unit and its peripheral circuits.

FIG. 6 is a view showing the structures of the control unit 30 and its peripheral circuits. The control unit 30 comprises an interface 31, an image processor 32, a memory 33, a drive system controller 34, and an ink amount calculator 35. The interface 31 allows transmission of signals between an external device, such as a computer, and the image processor 32, drive system controller 34 and ink amount calculator 35. The image processor 32 performs image processing based on image information inputted through the interface 31. The memory 33 stores the processed image data. Further, the image processor 32 is connected to a head drive circuit 41 for controlling driving of the recording head 12.

The drive system controller 34 is connected to a carriage drive circuit 42 for controlling the operation of a carriage motor 45 for driving the carriage 14, and to a paper transfer drive circuit 43 for controlling the operation of a paper transfer motor 46 for driving paper transferring members such as the paper feed roller 8, roller pair 11 and discharge rollers 16, and controls the movement of the carriage 14 and the transfer of the sheet P.

Connected to the ink amount calculator 35 is an ink amount detection control circuit 44 for controlling the oscillation of the quartz oscillator 23 of the ink detector 18 and detecting the oscillation frequency of the quartz oscillator 23 as a signal. The ink amount calculator 35 calculates the amount of ink ejected from the recording head 12, based on a change in the oscillation frequency of the quartz oscillator 23 corresponding to the amount of the deposited ink detected by the ink amount detection control circuit 44.

Figure 7:
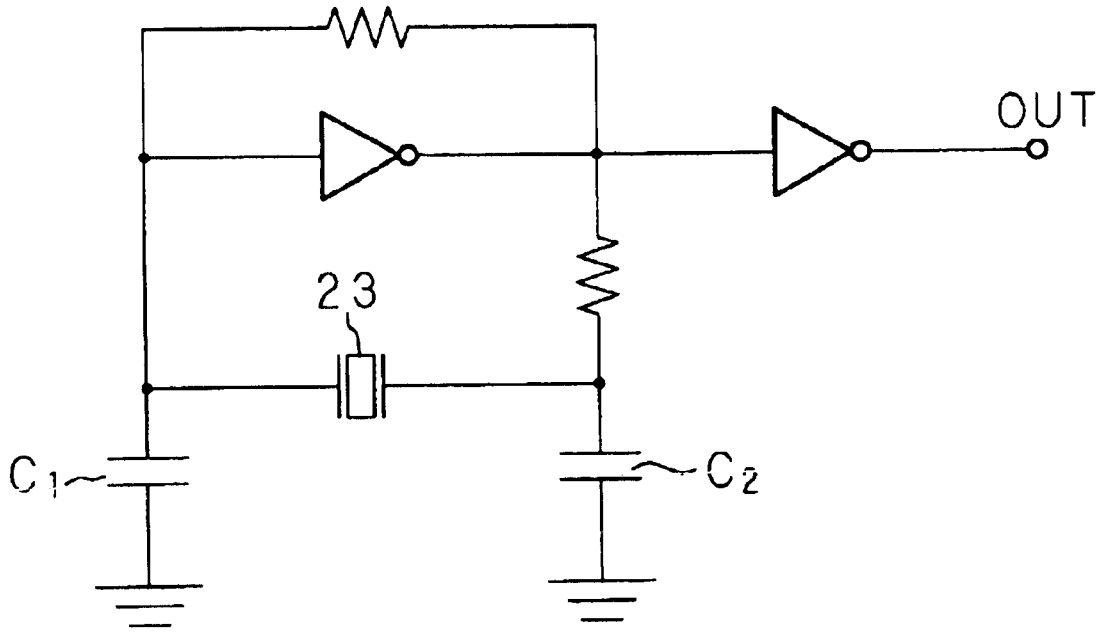
FIG. 7 is a view showing one example of the structure of an ink amount detection control circuit.

FIG. 7 is a view showing one example of the structure of the ink amount detection control circuit 44. The ink amount detection control circuit 44 includes a CMOS inverter, applies a voltage to both terminals (both Al electrodes 22) of the quartz oscillator 23 through capacitors $C_1$, $C_2$, and outputs the oscillation frequency from the quartz oscillator 23 as a signal.

The printing operation of the inkjet printer 1 of the present invention having such structures will be explained. A print request based on image information is inputted into the inkjet printer 1 through the interface 31 from an external device such as a computer (not shown). When the print request is received, a sheet P on the paper feed tray 7 is supplied from the paper feed unit 2 to the separating unit 3 by the pickup roller. The supplied sheet P is fed to the transfer unit 4 through the separating unit 3 by the paper feed roller 8. Thereafter, the sheet P is transferred to between the recording head 12 and the platen 13 by the roller pair 11.

Then, an ink is sprayed onto the sheet P on the platen 13 from a nozzle of the recording head 12, according to the image information. At this time, the sheet P is temporarily stopped on the platen 13. While the ink is being sprayed, the carriage 14 is guided to the guide shaft 15 to scan one line in a main scanning direction D2 (see FIG. 2). When one line of printing is complete, the sheet P is moved by the width of one line in a sub-scanning direction D1 (see FIG. 2) on the platen 13. By repeating such a process in the printing unit 5, printing on the entire surface of the sheet P is carried out. After the completion of printing, the sheet P goes through the ink drying section, and is then discharged as a printed matter onto the discharge tray 17 by the discharge rollers 16.

Next, the following description will explain an operation for measuring the amount of ink, which is a characteristic feature of the present invention. First, before ejecting the ink from the recording head 12, the quartz oscillator 23 of the ink detector 18 is oscillated by the ink amount detection control circuit 44 and the oscillation frequency is detected as an initial value in advance. Thereafter, an ink drop is ejected from the recording head 12 to the ink detector 18 only a predetermined times, and the oscillation frequency of the quartz oscillator 23 is detected. The difference between the detected value and the initial value, i.e., a change in the oscillation frequency corresponding to the amount of the deposited ink is obtained, and then the amount of the actually ejected ink is calculated based on the obtained change.

The following description will explain the degree of change caused in the oscillation frequency (resonant frequency) of the quartz oscillator 23 by deposition of the ink drops on the quartz oscillator 23, namely, numerical examples of the amount of the ink deposited on the quartz oscillator 23 and the change in the oscillation frequency of the quartz oscillator 23.

For example, when one ink drop of 16 pL [pico-liter], or four ink drops of 4 pL each, is deposited on the quartz oscillator 23 having an area of $(42.3\times10^{-4}\ [\mathrm{cm}])^2$ with the inkjet printer 1 of 600 DPI (a dot pitch of 42.3 [$\mu$m]), a thickness t [cm] of the deposited ink film is calculated as shown in (4) below.

$$t = 16\times10^{-9}\ [\mathrm{cm}^3]/(42.3\times10^{-4}\ [\mathrm{cm}])^2 = 8.94\times10^{-4}\ [\mathrm{cm}] \quad (4)$$

If the density of the ink is 1 [g/cm$^3$] and the mass detection sensitivity is 4.4 [ng/cm$^2$ Hz], when printing is performed over the entire area of the sheet P, $8.94\times10^{-4}$ [g] of ink per 1 [cm$^2$] is deposited on the quartz oscillator 23.

Accordingly, a change $\Delta F_0$ in the oscillation frequency is calculated as shown in (5) below.

$$\Delta F_0 = 8.94\times10^{-4}\ [g/cm^2]/4.4\times10^{-9}[g/cm^2\ Hz] = 203\ [kHz] \quad (5)$$

For example, when the electrode has an area of 1.3 [cm]×0.2 [cm]=0.26 [$cm^2$], the change $\Delta F_0$ in the oscillation frequency per 1-pL ink is calculated as shown in (6) below.

$$\Delta F_0 = \{1\times10^{-9}\ [g]/0.26\ [cm^2]\}/4.4\times10^{-9}[g/cm^2\ Hz] = 0.874\ [Hz] \quad (6)$$

Accordingly, with 100 drops of ink, each drop being 4 [pL] in amount, the change $\Delta F_0$ in the oscillation frequency is 350 (=0.874×4×100)[Hz], and consequently a change of $\Delta F_0/F_0$=350 [Hz]/10 [MHz]=35 [ppm] occurs.

Thus, since the present invention measures the mass of the ejected ink based on a change in the oscillation frequency of the quartz oscillator 23, it is possible to measure the amount of ink more sensitively and more accurately compared to conventional optical, piezoelectric, or electrostatic impact sensors that measure the pressure of an ink drop.

Figure 8:
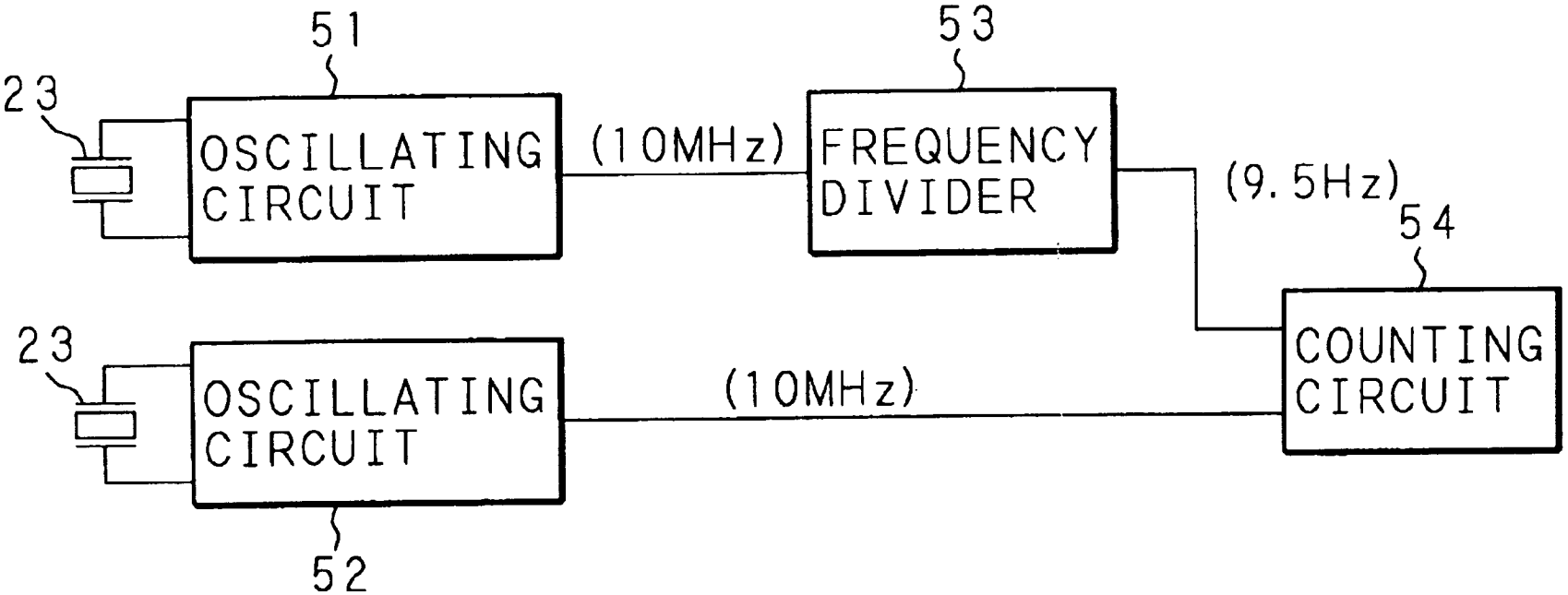
FIG. 8 is a view showing another example of the structure of the ink amount detection control circuit.

FIG. 8 is a view showing another example of the structure of the ink amount detection control circuit 44. The ink amount detection control circuit 44 comprises two oscillating circuits 51, 52 for oscillating two quartz oscillators 23, respectively; a frequency divider 53 constructed by connecting twenty stages of ½ frequency dividers; and a counting circuit 54 for counting the frequency. When the oscillation frequency of the quartz oscillator 23 is 10 [MHz], the output after the division by the frequency divider 53 is 9.5 [Hz] (=10 [MHz]/$2^{20}$).

If 9.5 [Hz] is converted to time, 104.85 [ms] is given. Then, a time change $\Delta T$ for 100 ink drops, each drop being 4 [pL] in amount, is calculated as shown in (7) below. Thus, even if a clock signal of 10 [MHz] is used, the mass of ink can be measured with sufficient resolution.

$$\Delta T = 104.85\ [ms]\times35\ [ppm] = 3.67\ [\mu s] \quad (7)$$

Figure 9:
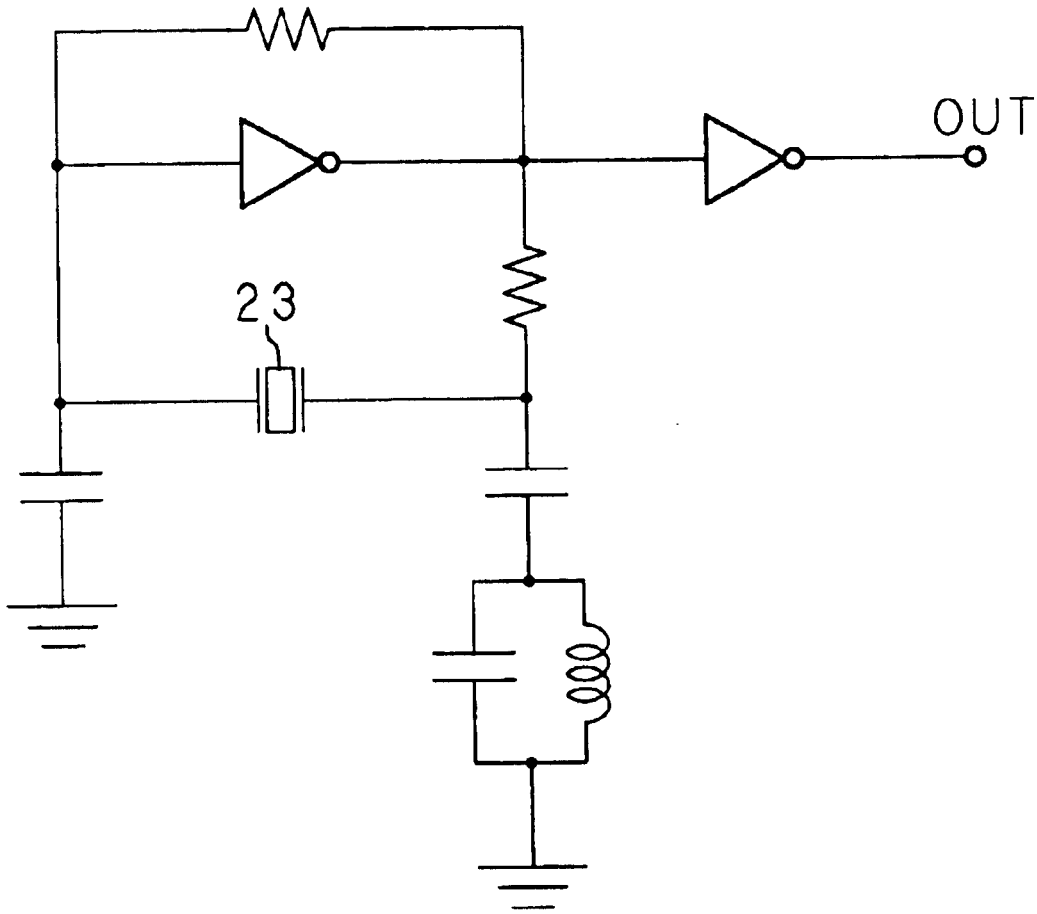
FIG. 9 is a view showing still another example of the structure of the ink amount detection control circuit.
Figure 10:
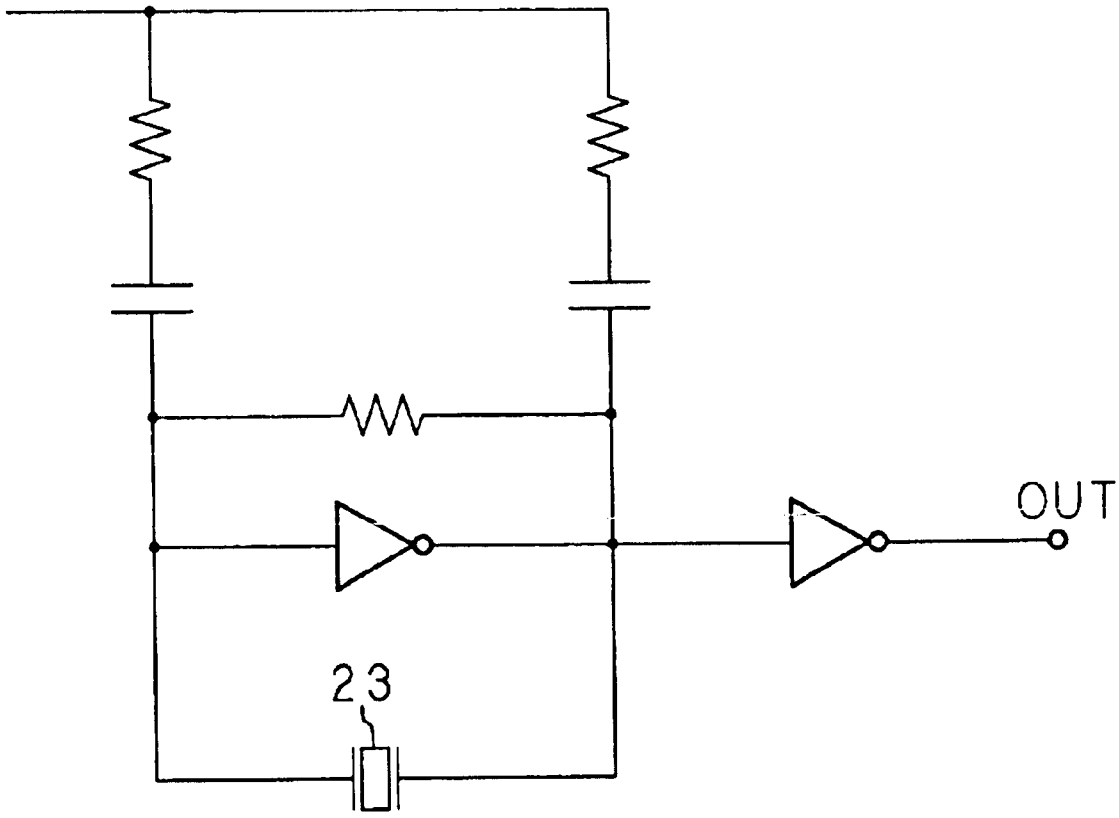
FIG. 10 is a view showing yet another example of the structure of the ink amount detection control circuit.

Moreover, in the present invention, an overtone quartz oscillator capable of providing overtone oscillation can be used as the quartz oscillator 23. FIG. 9 and FIG. 10 show an example of the structure of the ink amount detection control circuit 44 in such a case. The example shown in FIG. 9 is an overtone circuit using an LC tank circuit comprising a combination of a coil and a capacitor, while the example shown in FIG. 10 is an overtone circuit comprising only resistors and capacitors.

The following description will explain the degree of change caused in the oscillation frequency (resonant frequency) from such an overtone quartz oscillator by the deposition of ink drops on the overtone quartz oscillator, namely, numerical examples of the amount of the ink deposited on the overtone quartz oscillator and the change in the oscillation frequency of the overtone quartz oscillator.

For example, when the oscillation is increased by three times to overtone oscillation of 30 [MHz] and the mass detection sensitivity is 0.49 [ng/$cm^2$ Hz], a change $\Delta F_0$ in the oscillation frequency per 1-pL ink is calculated as shown in (8) below.

$$\Delta F_0 = \{1\times10^{-9}\ [g]/0.26\ [cm^2]\}/0.49\times10^{-9}[g/cm^2\ Hz] = 7.85\ [Hz] \quad (8)$$

Accordingly, with 100 drops of ink, each drop being 4 [pL] in amount, the change $\Delta F_0$ in the oscillation frequency is 3.14 (=7.85×4×100)[kHz], and consequently a change of $\Delta F_0/F_0$=3.14 [kHz]/30 [MHz]=104.67 [ppm] occurs.

Thus, in the example of the structure using the overtone quartz oscillator, it is possible to obtain several times higher detection sensitivity and improve the mechanical strength of the quartz oscillator compared to the fundamental oscillation.

As described in detail above, since the present invention uses the QCM method to detect a change in the resonant frequency of the oscillator which is caused by the deposition of ink on the oscillator and measures the amount of the ejected ink based on the detection results, the amount of the ink can be measured more sensitively and more accurately compared to conventional optical, piezoelectric, or electrostatic impact sensors that measure the pressure of an ink drop. In addition, it is also possible to accurately detect a defective nozzle from the measurement results of the amount of the ink.

In the present invention, since a plurality of ink drops are deposited, the ink drops on the oscillator change significantly, i.e., the ink drops expand, and a uniform ink film can be formed, thereby enabling highly accurate measurement.

In the present invention, since the oscillation is fundamental frequency oscillation (in the first oscillation mode), it is possible to obtain a stable and highly reliable oscillation state and improve the measurement accuracy for the amount of ink.

In the present invention, since the oscillator is vibrated by overtone oscillation, it is possible to obtain several times higher detection sensitivity compared to the fundamental oscillation, and improve the mechanical strength of the oscillator.

In the present invention, after dividing the frequency of the output of the oscillator, the cycle (frequency) is measured. It is therefore possible to perform measurement with high resolution.

In the present invention, since a surface of the oscillator on which the ink is to be deposited is covered with an insulating film, such as Parylene, treated to be hydrophilic, if necessary, it is possible to have particularly high surface leakage properties and good insulation properties and prevent deterioration due to ink.

In the present invention, since the oscillator is arranged horizontally, it is possible to form a uniform ink film with uniform self-weight and improve the measurement accuracy.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. The inkjet printer comprising:

a head for ejecting an ink;

an oscillator on which the ink ejected from said head is deposited;

a detector for detecting a change in resonant frequency caused in said oscillator when the ink is deposited on said vibrating oscillator; and a frequency divider for dividing the resonant frequency of said oscillator.

2. The inkjet printer of claim 1, wherein a surface of said oscillator on which the ink is to be deposited is covered with a hydrophilic film.

3. The inkjet printer of claim 1, wherein a surface of said oscillator on which the ink is to be deposited is arranged horizontally.

4. The inkjet printer of claim 1, wherein the surface of the oscillator is arranged horizontally under an ejecting face of the head that ejects an ink downward.

5. An inkjet printer comprising:

a head for ejecting an ink;

an oscillator on which the ink ejected from said head is deposited;

a detector for detecting a change in resonant frequency caused in said oscillator when the ink is deposited on said vibrating oscillator;

a calculator for calculating an amount of ink ejected from said head, based on the change in resonant frequency detected by said detector; and a frequency divider for dividing the resonant frequency of said oscillator.

6. The inkjet printer of claim 5, wherein a surface of said oscillator on which the ink is to be deposited is covered with a hydrophilic film.

7. The inkjet printer of claim 5, wherein a surface of said oscillator on which the ink is to be deposited is arranged horizontally.

8. The inkjet printer of claim 5, wherein the surface of the oscillator is arranged horizontally under an ejecting face of the head that ejects an ink downward.

9. The method for measuring an amount of ejected ink from a head of an inkjet printer, comprising the steps of:

depositing the ink ejected from the head on an oscillator;

detecting a change in resonant frequency caused in the oscillator when the ink is deposited on the vibrating oscillator; and calculating the amount of ink ejected from the head, based on the detected change in resonant frequency, wherein the resonant frequency of the oscillator is divided, and a change in resonant frequency is detected from results of the frequency division.

10. The method of claim 9, wherein a surface of the oscillator on which the ink is to be deposited is arranged horizontally.

11. The method of claim 9, wherein a surface of the oscillator on which the ink is to be deposited is covered with a hydrophilic film.

12. The method of claim 9, wherein the surface of the oscillator is arranged horizontally under an ejecting face of the head that ejects an ink downward.

* * * * *